US005457860A

United States Patent [19]

Miranda

[11] Patent Number: 5,457,860

[45] Date of Patent: Oct. 17, 1995

[54] RELEASABLE CLASP

[76] Inventor: Richard A. Miranda, P.O. Box 71, Lake Worth, Fla. 33460

[21] Appl. No.: 186,008

[22] Filed: Jan. 24, 1994

[51] Int. Cl.[6] ..... A44B 17/00

[52] U.S. Cl. ..... 24/656; 24/265 B

[58] Field of Search ..... 24/68 J, 71 J, 24/70 J, 613, 656, 657, 653, 265 B, 265 WS

[56] References Cited

U.S. PATENT DOCUMENTS

| | | | |
|---|---|---|---|
| 237,343 | 2/1881 | Vester | 24/613 |
| 753,486 | 3/1904 | Hansen . | |
| 941,096 | 11/1909 | Pugatsky et al. . | |
| 1,608,807 | 11/1926 | Ogush . | |
| 2,725,610 | 12/1955 | Smith . | |
| 2,740,180 | 4/1956 | Nobles | 24/265 B X |
| 4,310,953 | 1/1982 | Nanasi . | |
| 4,675,955 | 6/1987 | Nakamura . | |
| 5,191,685 | 3/1993 | Aoki et al. . | |

FOREIGN PATENT DOCUMENTS

| | | | |
|---|---|---|---|
| 656512 | 7/1986 | Switzerland | 24/265 WS |

*Primary Examiner*—James R. Brittain
*Attorney, Agent, or Firm*—Basile and Hanlon

[57] ABSTRACT

A clasp includes releasably interconnectable first and second clasp members. The first clasp member has a hollow, cylindrical shape with first and second ends and a side wall. The second clasp member includes a hollow, cylindrical outer tubular member with opposed first and second ends. A first inner tubular member is slidably disposed within the first end of the outer tubular member. A second inner tubular member is mounted in the second end of the outer tubular member. A biasing spring mounted within the outer tubular member normally biases the first inner tubular member to a longitudinally outward position with respect to the first end of the outer tubular member. In one embodiment, the second inner tubular member is fixedly mounted within the second end of the outer tubular member. In another embodiment, the second inner tubular member is slidably mounted within the outer tubular member. Lock members are mounted on the first and second inner tubular members and releasably engage complimentarily-shaped lock receiving members formed on the first and second end walls of the first clasp member for releasably locking the first and second clasp members together.

11 Claims, 4 Drawing Sheets

RELEASABLE CLASP

CROSS REFERENCE TO RELATED CO-PENDING APPLICATION

The present invention describes and claims subject matter which is related to the invention described and claimed in a co-pending application filed on Jan. 24, 1994 in the name of Richard Miranda and entitled "CLASP".

BACKGROUND OF THE INVENTION

1. Field of the Invention

The present invention relates, in general, to clasps or fasteners for releasably securing two elements together, and specifically, to clasps for securing the ends of jewelry, such as necklaces, bracelets, watch bands, etc. together.

2. Description of the Art

Clasps are used to secure two elements, such as the ends of jewelry, for example, necklaces, bracelets, watch bands etc., together around the neck, arm, etc., of a user. Typically, one clasp member is connected to one end of the piece of jewelry and includes a movable member which selectively moves between open and closed positions to receive a mating clasp member attached to the other end of the piece of jewelry.

A typical clasp previously created by the present inventor is shown in FIGS. 1 and 2. This clasp 10 includes a hollow, outer tubular member 12 having a loop 14 connected to a flange 15 extending outward from a side wall of the tubular member 12 which is attached by a pin or other fastener means, not shown, to one end of a bracelet, necklace, etc. An aperture 16 is formed in the side wall of the tubular member 12 intermediate the opposed ends thereof and opens to the interior, of the tubular member.

A planar member 18 is slidably mounted in the tubular member 12. An irregularly shaped opening 20 is formed in the planar member 18 leaving an arm 22 which extends axially along one side of the planar member 18 in the direction of movement of the planar member 18. The end of the arm 22 is spaced from an opposed portion of the planar member 18. A disk 24 is soldered onto one end of the planar member 18 to form a seat for a coil spring 26 which is disposed within the tubular member 12 between the disk 24 and another disk 25 which is press fit within an end cup 28 affixed to one end of the tubular member 12 after the spring 26 has been inserted into the tubular member 12.

The coil spring 26 biases the planar member 18 toward the opposite end 32 of the tubular member 12. A C-ring 30 and a split ring 31 are fixedly mounted in a spaced apart manner within the tubular member 12 to limit the axial movement of the planar member 18 toward the end 32 of the tubular member 12 and, in the case of the split ring 31, to also limit the angular movement of the planar member 18 within the tubular member 12.

In a normal position shown in FIG. 2, the coil spring 26 biases the planar member 18 such that one end 34 of the planar member 18 extends outward beyond the end 32 of the tubular member 12 where the end 34 of the planar member 18 is fixedly joined to an end cap 36. Also, in this normal position, the arm 22 on the planar member 18 extends across the aperture 16 in the tubular member 12. Depression of the end cap 36 to the right, as viewed in the orientation shown in FIG. 2, slidably urges the planar member 18 to the right against the coil spring 26 until the arm 22 on the planar member 18 is spaced from the aperture 16. This opens the aperture 16 for insertion or removal of a latch member 38, shown in FIG. 1, which is typically in the form of an arch-shaped member mounted on a mating clasp member 40 attached to the other end of the piece of jewelry.

After the latch member 38 is inserted through the aperture 16 in the outer tubular member 12, subsequent release of the end cap 36 enables the coil spring 26 to urge the planar member 18 to the left, as viewed in FIG. 2, until the arm 22 passes interiorly through the latch member 38 and across the aperture 16 in the tubular member 12 to fixedly connect the tubular member 12 to the mating clasp member 40. Further, decorative elements 37 may be mounted in the end cup 28 and the end cap 36.

While this clasp 10 securely joins the ends of a bracelet, necklace, etc., together, it requires time consuming labor to properly position the C-ring 30 and the split ring 31 at the proper position inside of the tubular member 12. In addition, the soldering of the circular end cap 36 to one end 34 of the planar member 18 forms a relatively weak joint between these two components which is susceptible to breakage. Another weak point is the soldered connection between the end of the relatively thin planar member 18 and the disk 24.

The same problems confront another prior art clasp made by the Applicant which is partially shown in FIG. 3. This prior art clasp is substantially the same as the prior art clasp described above and shown in FIG. 1 with two exceptions. In this clasp, the planar member 18 lacks an arm 22. The latch feature is provided by an arcuate member 50 which is secured by soldering, etc., to the bottom edge of the first end of the planar member 18 adjacent to the disk 24. The arcuate member 50 has side edge portions which extend outwardly from opposite sides of the planar member 18 and slidably engage a latch member 52 formed on the first clasp member 40. The latch member 52 is formed of first and second, inverted, L-shaped members 54 and 56, each having a first leg 58 attached to and extending outwardly from one surface of the clasp member 40. An inwardly extending leg 60 extends generally perpendicular from the outer end of the first leg 58 and extends toward but is spaced from the second leg 60 of the opposite L-shaped member 54 or 56. The L-shaped members 54 and 56 form an opening therebetween through which the arcuate member 50 on the planar member 18 slidably extends, in the same manner as described above, to releasably connect the clasp member 40 to the tubular member 12 in which the planar member 18 is mounted.

Thus, it would be desirable to provide a clasp which not only has a strong connection between its components; but which is also easy to operate and can be constructed in a small overall size.

SUMMARY OF THE INVENTION

The present invention is a clasp for releasably securing two movable members, such as the opposed ends of a piece of jewelry together.

The present clasp includes first and second releasably interconnectable clasp members. The first clasp member is in the form of a hollow, cylindrical body having first and second opposed end walls, and a side wall extending therebetween. An arcuate opening is formed in the side wall of the first clasp member and extends over a substantial angular portion of the side wall. The aperture terminates at opposed ends spaced from the first and second ends of the outer tubular member. Diametrically extending slots are formed in the first and second ends of the first clasp member.

The second clasp member includes a hollow, outer tubular member having a side wall and first and second opposed ends. A first inner tubular member is slidably mounted in the first end of the outer tubular member and has first and second opposed ends. A planar stem is mounted on and extends longitudinally outward from a first end of the first inner tubular member. An end cap is fixedly mounted on an outer end of the stem. Guide means, mounted on the first inner tubular member and the outer tubular member, guide the sliding movement of the first inner tubular member within the outer tubular member. A second stem is mounted on and extends longitudinally outward from the second end of the outer tubular member or, in another embodiment, from a second inner tubular member mounted in the second end of the outer tubular member. A second end cap is mounted on an outer end of the second stem. Biasing means, mounted within at least the first inner tubular member and the outer tubular member and biases the first inner tubular member normally outward from the first end of the outer tubular member to increase the distance between outer ends of the first and second inner tubular members to a predetermined distance, the predetermined distance being slightly less than an inside distance between the first and second end walls of the first clasp member.

Lock means are formed on the first and second end walls of the first clasp member and on the first and second inner tubular members for releasably locking the first and second clasp members together. In one embodiment, at least one lock member is mounted on each of the first and second stems of the first and second inner tubular members. A lock member receiving means, such as a notch, is formed on each of the first and second end walls of the first clasp member and has a shape complimentary to the shape of the lock member for lockingly engaging the lock members when the first and second clasp members are joined together and at least the first inner tubular member is slidably urged outward from one end of the outer tubular member, with the first and second stems slidably extending through the slots in the first and second end walls of the first clasp member.

The lock members are provided in a variety of shapes, including an arcuate shape, a polygonal shape, a triangular or wedge shape, and complimentarily-formed notches are provided in the first and second end walls of the first clasp member. In an alternate embodiment, the lock members are in the form of a tubular pin extending longitudinally outward from the second ends of the first and second inner tubular members which releasably engages a bore formed in each of the first and second end walls of the first clasp member. The lock member may also comprise a cylindrical boss mounted on the second ends of the first and second inner tubular members adjacent to each of the first and second stems, respectively. The notches formed in the first and second end walls of the first clasp members are sized to slidably engage each of the cylindrical bosses.

In another embodiment, the first and second end walls of the first clasp member terminate in an upper edge generally co-planar with an upper edge of the side wall of the first clasp member. Inwardly extending lips are formed on each of the upper edges of the first and second end walls and extend inward over the hollow interior of the first clasp member formed by the side wall thereof. A pair of lock members are mounted on and extending outward from opposite sides of each of the first and second stems to slide beneath the lips when the first and second clasp members are joined together. In an alternate embodiment, the inward extending lips are replaced by a pair of notches formed in each of the first and second end walls adjacent to the upper edges thereof. The lock members slidably engage the notches when the first and second clasp members are joined together and at least the first inner tubular member is slidably urged outward from the outer tubular member.

In another embodiment, the second inner tubular member is slidably mounted within the second end of the outer tubular member. The biasing means is operative to bias both of the first and second inner tubular members to normal outwardly extending positions with respect to opposite ends of the outer tubular member. Guide means are formed in each of the first and second inner tubular members and the outer tubular member for retaining and, also, guiding the sliding movement of the first and second inner tubular members with respect to the outer tubular member.

Compressive force applied to the first and second end caps of the first and second inner tubular members causes the first inner tubular member in the first embodiment and both of the first and second inner tubular members in the alternate embodiment to move longitudinally inward within the outer tubular member to shorten the distance between the outer ends of the first and second inner tubular members to a distance which is less than an inside distance between the inner edges of the collars formed at opposite ends of the first clasp member. This enables the first and second clasp members to be joined together by sliding the stems on the first and second inner tubular members through the slots formed in the end walls of the first clasp member, with the cylindrical body portion of the first tubular member and the end portions of the outer tubular member, or in the alternate embodiment, the end portion of the second inner tubular member clearing the end walls of the first clasp member. Release of the compressive force on the end caps enables the biasing spring to urge the movable first and/or the movable first and second inner tubular members longitudinally outward from the outer tubular member such that the stems slide through the slots in the end walls of the first clasp member and the lock members engage the lock member receiving means on the first clasp member.

The clasp of the present invention is formed of strong components which are rigidly joined together to form a strong connection between such components. This increases the reliability and useful life of the present clasp. At the same time, the clasp of the present invention is easy to operate to either interconnect or separate the first and second clasp members. Further, the clasp may be formed with a small overall length to permit its use on numerous small sized articles. Finally, the clasp is designed to securely lock the two clasp members thereof together which can eliminate the need for a safety chain.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
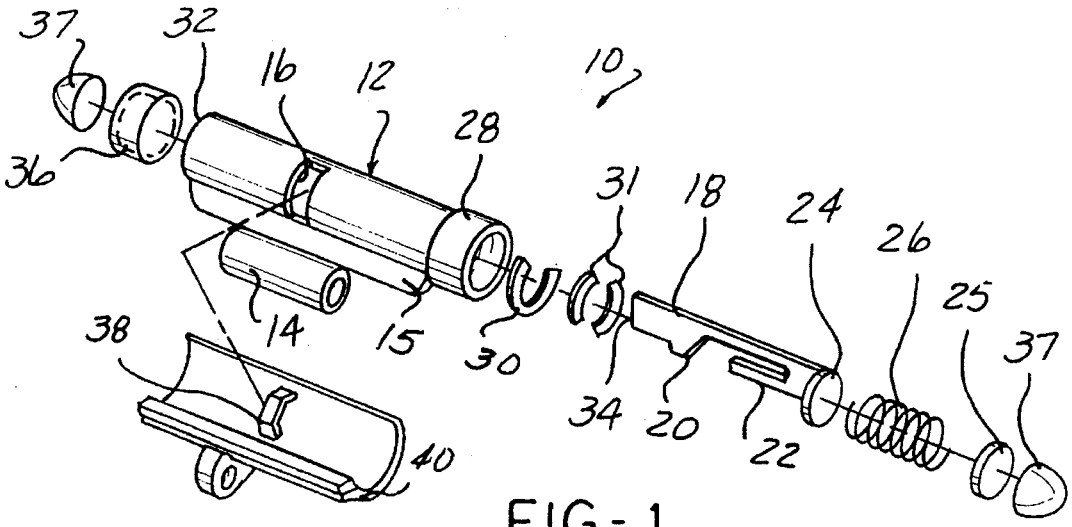
FIG-1 PRIOR ART
FIG. 1 is an exploded, perspective view of a prior art clasp.
Figure 2:
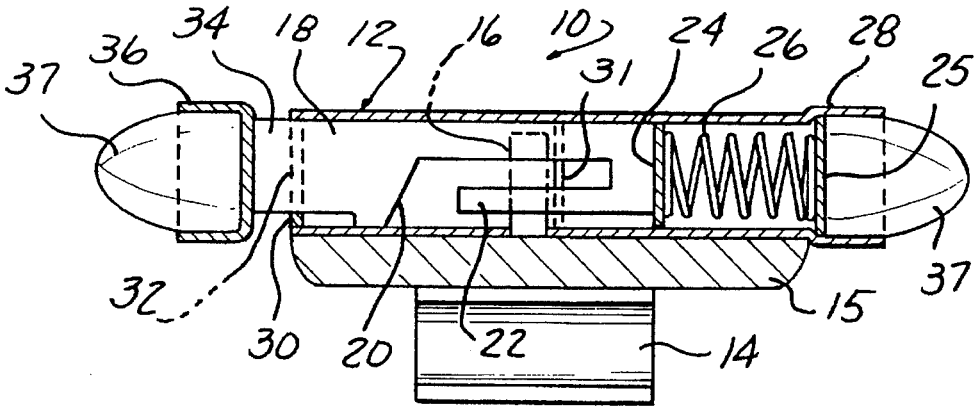
FIG-2 PRIOR ART
FIG. 2 is a side elevational view of the assembled prior art clasp of FIG. 1.
Figure 3:
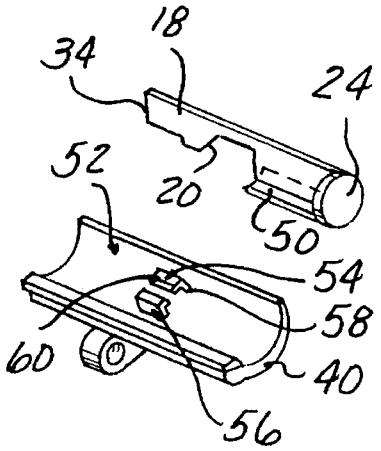
FIG-3 PRIOR ART
FIG. 3 is a partial, exploded, perspective view of another prior art inner tubular member and first clasp member usable in the clasp shown in FIG. 1.

Referring now to the drawings, and to FIGS. 4, 5, 6 and 7 in particular, there is depicted one embodiment of a clasp 70 constructed in accordance of the teachings of the present invention. Although the present clasp 70 is described hereafter in conjunction with a piece of jewelry, such as a necklace, bracelet, watch band, etc., it will be understood that the clasp 70 has many other applications and can be used wherever two elements are to be releasably connected such as a purse flap, belt buckle, coat pocket flap, to name a few.

In general, the clasp 70 is formed of first and second clasp members 72 and 74, respectively, which are releasably interconnectable to secure opposite ends of a piece of jewelry, such as a necklace, bracelet, etc., not shown, together.

Figure 4:
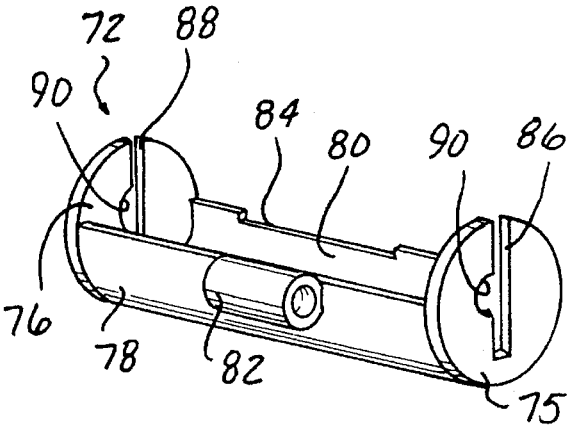
FIG. 4 is a perspective view of one embodiment of a first clasp member constructed in accordance of the teachings of the present invention.

The first clasp member 72 is in the form of a substantially cylindrical, hollow, tubular member having a first end wall 75 and an opposed second end wall 76. A side wall 78 extends between the first and second end walls 75 and 76. An arcuate opening 80 is formed in the side wall 78 extending over a substantial angular portion of the side wall 78. As shown in FIG. 4, the arcuate opening or aperture 80 leaves a solid portion of the side wall 78 which extends over approximately half of the diameter of the cylindrical first clasp member 72.

A joining member 82 in the form of a tube, pin, etc., is mounted to the exterior surface of the side wall 78 for receiving a pin or other suitable fastener, not shown, for attaching the first clasp member 72 to one end of a piece of jewelry, not shown. A notch 84 is formed on the opposite edge of the side wall 78, the purpose of which will be described hereafter.

A diametrically extending slot 86 and 88 is formed in each end wall 75 and 76, respectively, and extend from one side of each end wall 75 and 76 to a closed end spaced from an opposite diametrical edge of each end wall 75 and 76 as shown in FIG. 4. An arcuate shaped notch 90 is formed on one edge of each end wall 75 and 76 and opens to the slots 86 and 88. The notches 90 form part of a releasable lock means as described hereafter.

Figure 5:
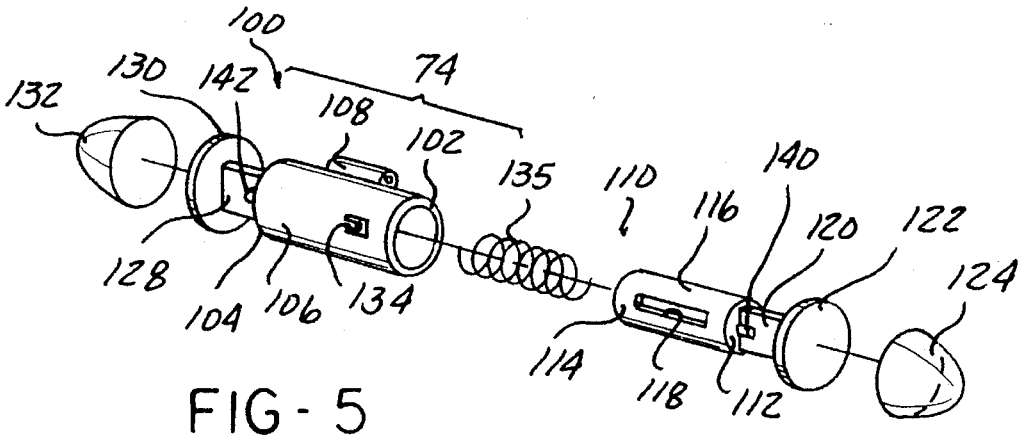
FIG. 5 is an exploded, perspective view of one embodiment of a second clasp member according to the prevent invention useable with the first clasp member shown in FIG. 4.

The detailed construction of the second clasp member 74 is shown in FIG. 5. As shown therein, the second clasp member 74 includes an outer tubular member 100 having a generally cylindrical, hollow, tubular form with a first end 102, an opposed second end 104 and a solid side wall 106 extending therebetween. A joining member 108 is secured to the side wall 106 by soldering, etc. The joining member 108, which may be in the form of a tube, pin, etc., is adapted to receive a pin or other suitable fastener, not shown, for attaching the outer tubular member 100 of the second clasp member 74 to one end of a piece of jewelry, also not shown. The joining member 108 fits into the notch 84 in the side wall 78 of the first clasp member 72 when the first and second clasp members 72 and 74 are joined together. The notch 84 is slightly longer than the length of the joining member 108 to effect a smooth engagement of the first and second clasp members 72 and 74 by permitting lateral movement of the second clasp member 74 within the first clasp member 72.

A first inner tubular member 110 has the form of a hollow, cylindrical, tubular member with a solid first end 112 and an opposed, open, second end 114. A side wall 116 extends between the first and second ends 112 and 114. A longitudinally extending slot 118 is formed in the side wall 116, the purpose of which will be described in greater detail hereafter.

A stem 120 in the form of a planar member having a width less than or equal to the outer diameter of the side wall 116 of the first inner tubular member 110 extends longitudinally outward from the first end 112. An end cap 122 is mounted on the outer end of the stem 120. The first end cap 122 may be in the form of a planar disk, as shown in FIG. 5. Alternately, the first end cap 122 may be in the form of a hollow cup having a solid end wall joined to one end of the stem 120. In either embodiment, a decorative element 124, such as a precious or semi-precious stone, etc., may be mounted by adhesive or other suitable means to the first end cap 122.

It should be noted that the outer diameter of the side wall 116 of the first tubular member 110 is slightly smaller than the inner diameter of the outer tubular member 100 so as to permit free sliding movement of the first tubular member 110 within the outer tubular member 100 as described hereafter.

A second stem 128 also having a width less than or equal to the outer diameter of the outer tubular member 100 is attached to and extends longitudinally from the second end 104 of the outer tubular member 100. A second end cap 130 in the form of a planar disk or a hollow cup is mounted on the outer end of the stem 128 for receiving a decorative element 132.

A biasing means 135, preferably in the form of a coil spring, is mounted within the hollow interior of the outer tubular member 100 and the first tubular member 110 and seats between the second end 104 of the outer tubular member 100 and the first end wall 112 of the first inner tubular member 110 at another end. The biasing means 135 normally biases an outer end portion adjacent the end 112 of the first inner tubular member 110 outward from the first end 102 of the outer tubular member 100.

Guiding and locking means are provided for slidably mounting the first inner tubular member 110 in the outer tubular member 100. The guiding and locking means preferably comprises at least one tab 134 which is formed in the side wall 106 of the outer tubular member 100 and spaced a short distance from the first end 102 of the outer tubular member 100 as shown in FIG. 5. Although the tab 134 is shown as being spaced from the first end 102 of the outer tubular member 100, it will be understood that the tab 134 may also be formed directly on the first end 102 of the outer tubular member 100.

The tab 134 is designed to be bent or deformed into the slot 118 in the first inner tubular member 110 after the first inner tubular member 110 has been slidably inserted through the open first end 102 into the outer tubular member 100. The tab 134 slidably engages the slot 118 in the first inner tubular member 110 to retain the first inner tubular member 110 within the outer tubular member 100 while permitting free sliding movement of the inner tubular member 110 therein to a set outward extension. The tab 134 also functions to retain the first inner tubular member 110 at a set angular position with respect to the outer tubular member 100 as shown in FIG. 5.

Optionally, a pair of diametrically opposed tabs 142 may be provided, with each tab 142 engaging a pair of diametrically opposed slots 118 formed in the first inner tubular member 110.

As shown in FIGS. 4–7, releasable lock means are provided on the first and second clasp members 72 and 74 to enable the first and second clasp members 72 and 74 to be fixedly joined together and, at the same time, to be easily separated from each other. According to this embodiment, the releasable lock means includes lock members 140 and 142 in the form of semi-cylindrical members fixedly mounted at the juncture of one end of the stem 120 and the end wall 112 of the first inner tubular member 110 and the juncture of the second stem 128 and the solid second end 104 of the outer tubular member 100. The lock members 140 and 142 have a shape complimentary to the shape of the lock member receiving notches 90 formed in the first and second end walls 75 and 76 of the first clasp member 72 as shown in FIG. 4. During sliding movement of the first inner tubular member 110 within the outer tubular member 100, as described hereafter, the lock members 140 and 142 slidably engage or disengage the notches 90 formed in the end walls 75 and 76 of the first clasp member 72 to effect releasable interconnection or separation of the first and second clasp members 72 and 74 to and from each other.

Figure 6:
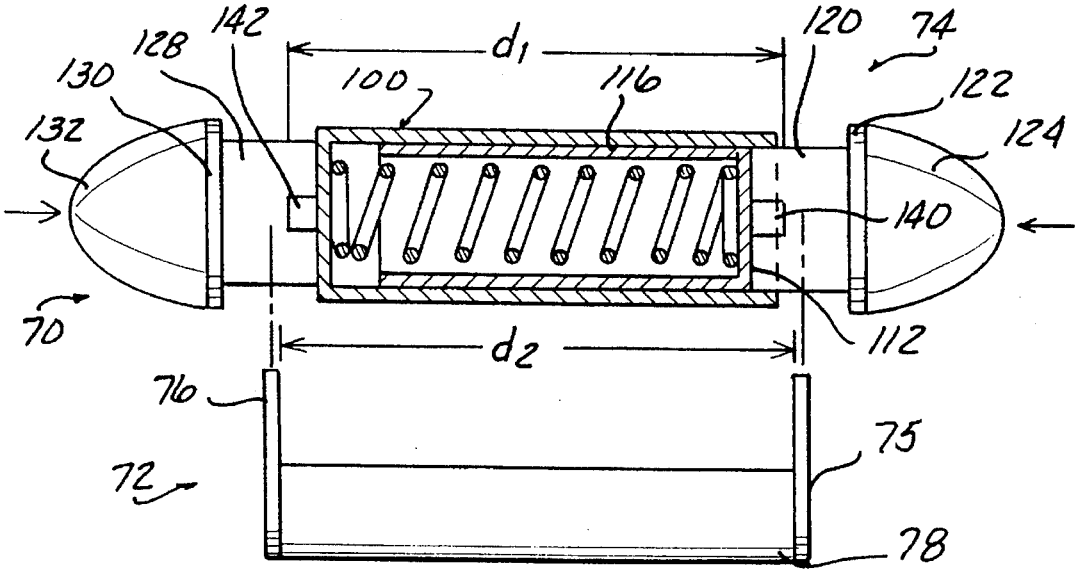
FIG. 6 is a partially exploded longitudinal cross sectional view showing the second clasp member in a compressed state for insertion into or removal from the first clasp member.

FIG. 6 depicts a pre-assembled position of the first and second clasp members 72 and 74 of the clasp 70. In this state, compressive force has been applied to the first and second end caps 122 and 130, respectively, through the decorative elements 124 and 132 respectively mounted thereon. This compressive force causes the first inner tubular member 110 to slide into the outer tubular member 100 through the first end 102 thereof and shortens the distance or length between the opposed end caps 122 and 130.

Figure 7:
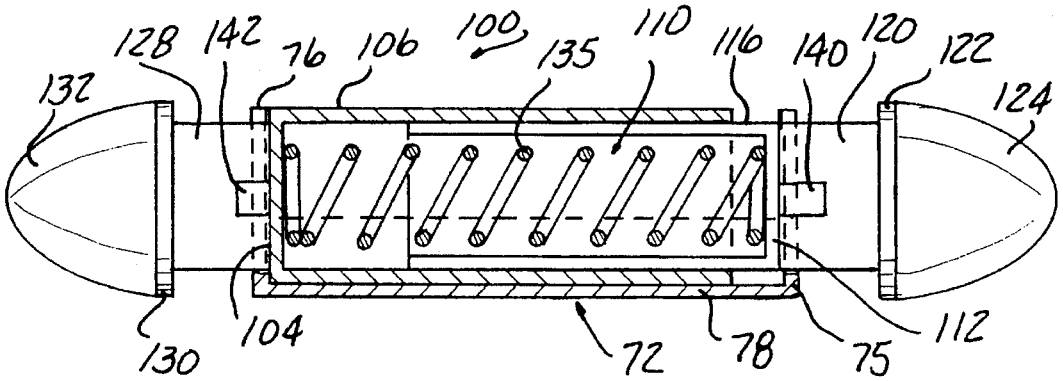
FIG. 7 is a longitudinal cross sectional view showing the first and second clasp members depicted separately in FIGS. 4 and 5 in an interconnected, locked state.

In this compressed state, as shown in FIG. 6, the distance or dimension $d_1$ between the outer ends of the lock members 140 and 142 is slightly less than the distance $d_2$ between the inside edges of the end walls 75 and 76 of the first clasp member 72. This permits the second clasp member 74 to be slidably inserted into the first clasp member 72 through the aperture 80, by sliding the stems 120 and 128 through the respective slots 86 and 88 in the first clasp member 72 as shown in FIG. 7. When the first and second clasp members 72 and 74 are firmly joined together, release of the compressive force applied to the first and second end caps 122 and 130 enables the biasing spring 135 to slide the first tubular member 110 longitudinally outward from the outer tubular member 100 and to slide both lock members 140 and 142 into the notches 90 in the first clasp member 72, with the stems 120 and 128 extending longitudinally outward through the slots 86 and 88 beyond the first and second end walls 75 and 76 of the first clasp member 72.

When it is desired to separate the first and second clasp members 72 and 74 from each other, compressive force is again applied to the opposed end caps 122 and 128 to bring the lock members 140 and 142 to the shortened overall dimensional length $d_1$ shown in FIG. 6. This enables the second clasp member 74 to be separated from the first clasp member 72 by sliding the stems 120 and 128 outward from the slots 86 and 88 in the first clasp member 72.

Figure 8:
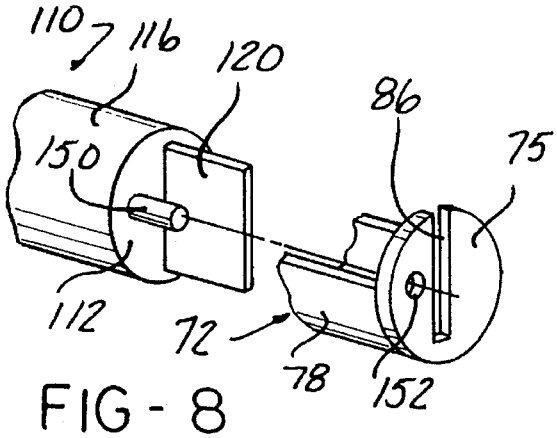
FIG. 8 is a partial, exploded, perspective view of another embodiment of the lock means mounted on the first and second ends of the first and second clasp members.

An alternate lock means is shown in FIG. 8. In this embodiment, the first stem 120 and the slot 86 in the first end wall 75 of the first clasp member 72 are identically formed to the first embodiment described above and shown in FIGS. 4 and 5. The lock member, in this embodiment, comprises a tubular member 150, such as a cylindrical pin, which is fixedly mounted on and extends longitudinally outward from the solid end wall 112 of the first inner tubular member 110. A bore 152 is formed in the first end wall 75 of the first clasp member 72 at a position to slidably receive the lock member 150 when the first tubular member 110 is slidably urged outward from the outer tubular member 100 as described above to fixedly engage and lock the first and second clasp members 72 and 74 together. The bore 152 may extend completely through the first end wall 75 or, in an alternate embodiment, only partially through the first end wall 75 from the inner surface of the end wall 75. An identical tubular member 150 is mounted on the second end 104 of the outer tubular member 100 and engages a bore identical to bore 152 in the end wall 76 of the first clasp member 72.

It will be understood that in all of the alternate lock means shown in FIGS. 9–12 and described hereafter, only the lock means at one end of the clasp 70 is shown and an identical lock means is employed at the other or second end of the clasp 70.

Figure 9:
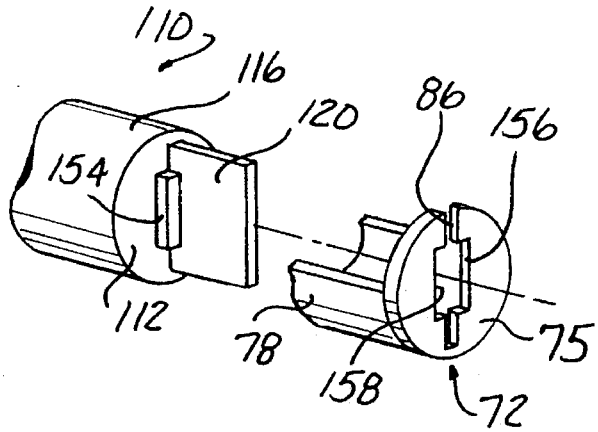
FIG. 9 is a partial, exploded, perspective view of another embodiment of the lock means on the first and second ends of the first and second clasp members.

Yet another embodiment of the lock means is shown in FIG. 9. In this embodiment, the lock means comprises at least one and preferably two rectangular, bar-shaped members 154, which are mounted on opposite sides of the first stem 120 at the juncture of the first stem 120 and the solid end wall 112 of the first inner tubular member 110. Complimentarily-shaped enlarged notches 156 and 158 are formed in the end wall 75 surrounding the slot 86 to slidably receive the lock members 154 when the first inner tubular member 110 is biasingly urged outward from the outer tubular member 100, as described above, to lockingly engage the first and second clasp members 72 and 74 together.

Figure 10:
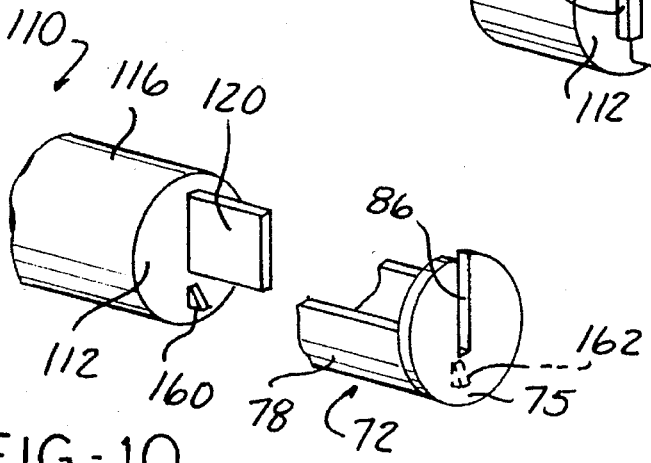
FIG. 10 is a partial, exploded, perspective view of another embodiment of the lock means on the first and second ends of the first and second clasp members.

FIG. 10 depicts yet another embodiment of the lock member of the present invention in which the lock means is formed of a generally triangular or wedge-shaped member 160 fixedly mounted on and extending longitudinally outward from the solid end 112 of the first inner tubular member 110. The lock member 160 may be positioned co-planarly with the first stem 120 or laterally offset therefrom. A complimentarily-shaped, triangular or wedge-shaped recess 162 is formed at a predetermined position in the first end wall 75 of the first clasp member 72 to slidably receive and engage the lock member 160.

Figure 11:
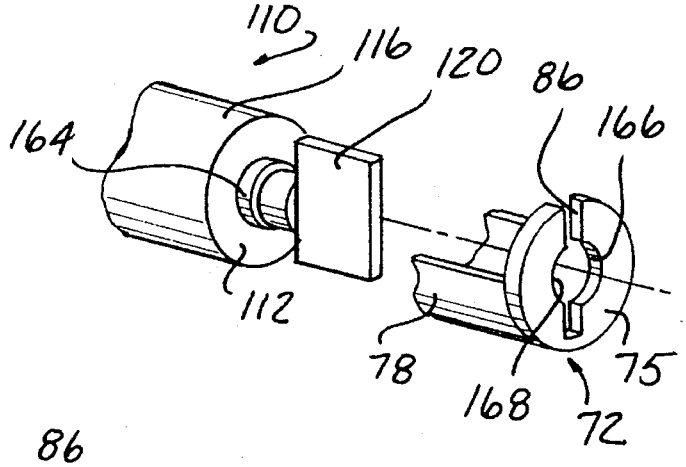
FIG. 11 is a partial, exploded, perspective view of another embodiment of the lock means on the first and second ends of the first and second clasp members.

Yet another embodiment of the lock means of the present invention is shown in FIG. 11 in which an enlarged cylindrical boss 164 is formed between one end of the first stem 120 and the solid end 112 of the first inner tubular member 110. Complimentarily-shaped, circular-shaped openings 166 and 168 are formed in the first end wall 75 of the first clasp member 72 centrally along the length of the slot 86 to slidably receive and engage the cylindrical boss 164 when the first stem 120 is slidably urged along with the first inner tubular member 100 through the slot 86 to releasably interconnect the first and second clasp members 72 and 74 together.

Figure 12:
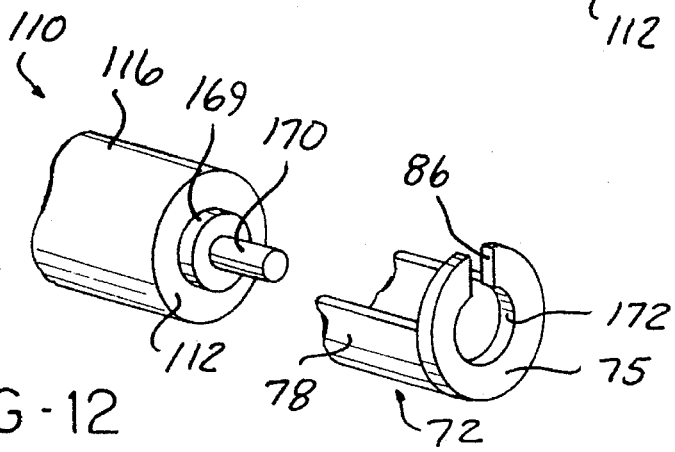
FIG. 12 is a partial, exploded, perspective view of another embodiment of the lock means on the first and second ends of the first and second clasp members.

In FIG. 12, another embodiment of the lock means is depicted. In this embodiment, the lock means includes a cylindrical boss 168 mounted on the end wall 112 of the first inner tubular member 110. A cylindrical stem 170 extends longitudinally outward from the cylindrical boss 168. A circular-shaped opening 172 is formed at an end of the slot 86 in the first end wall 75 of the first clasp member 72 to slidably receive the cylindrical boss 168 when the first inner tubular member 110 is slidably urged outward from the outer tubular member 100. It should be noted, that in this embodiment, the narrow slot 86 may be deleted and only a circular-shaped opening 172 provided in the first end wall 75 to receive the cylindrical boss 168 and the cylindrical stem 170 on the first inner tubular member 110.

Figure 13:
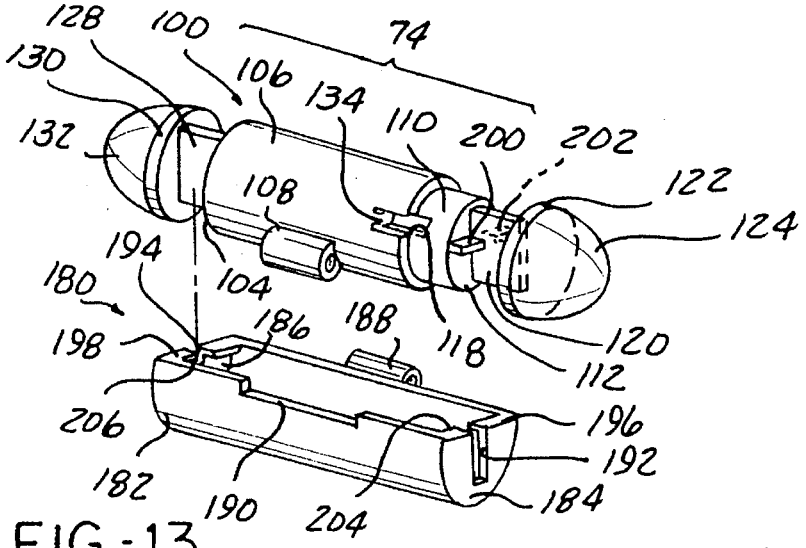
FIG. 13 is an exploded, perspective view showing yet another embodiment of the first and second clasp members constructed in accordance with the teachings of the present invention.

Another embodiment of the clasp of the present invention is shown in FIG. 13. In this embodiment, the second clasp member 74 includes elements identical to the first embodiment shown in FIG. 5 and described above. Specifically, the second clasp member 74 shown in FIG. 8 includes an outer tubular member 100 and a first inner tubular member 110 identically constructed to the first embodiment of the clasp 70. At least one tab 134 is formed in the first end 102 of the outer tubular member 100 for slidably engaging a slot 118 formed in the first inner tubular member 110 for slidably retaining the first inner tubular member 110 within the outer tubular member 100.

In this embodiment, the first clasp member 180 is in the form of a cylindrical body having a semicircular shaped side wall 182 which terminates in opposed first and second end walls 184 and 186, respectively. A joining member 188 is mounted on the side wall 182 for joining the first clasp member 180 to a piece of jewelry or other article, not shown. A notch 190 is formed on an opposite edge of the side wall 182 for engaging the joining member 108 formed on the second clasp member 74 and functions in the same manner as the notch 84 described previously.

Aligned slots 192 and 194 are formed in and extend linearly through the first and second end walls 184 and 186 from an open end adjacent an upper edge of each end wall 184 and 186 to an opposed closed end. An enlarged lip 196 and 198 is formed on the upper end of each of the end walls 184 and 186 and extends from the respective end walls 184 and 186 over the hollow interior of the first clasp member 180 formed by the surrounding portions of the side wall 182.

The lock means in this embodiment is formed of a pair of tubular members 200 and 202 which may have either the depicted rectangular shape, as well as a cylindrical or other shape. The tubular members 200 and 202 are mounted on and extend outward from opposite sides of the first stem 120 at or spaced from the juncture of the first stem 120 and the end wall 112 of the first tubular member 110. Although not shown in FIG. 13, an additional pair of tubular members 200 and 202 are mounted on the second stem 128 at or spaced from the juncture of the second stem 128 and the solid second end 104 of the outer tubular member 100.

The embodiment shown in FIG. 13 functions in substantially the same manner as the first embodiment of the present invention shown in FIGS. 4–7 in that compressive force, when applied to both of the end caps 122 and 130, causes the first inner tubular member 110 to be slidably urged within the first end 102 of the outer tubular member 100. In this compressed state, the distance between the outer ends of the each pair of tubular members 200 and 202 is decreased to a distance less than the inside distance between the inner edges 204 and 206 of the lips 196 and 198 on the first clasp member 72 permitting the second clasp member 74 to be slidably inserted into the first clasp member 180, with the stems 120 and 128 slidably engaging the slots 192 and 194 in the first clasp member 72. Release of the compressive force on the end caps 122 and 128 enables the biasing means 135 to expand thereby slidably urging the first inner tubular member 110 longitudinally outward from the outer tubular member 100 to bring the each pair of tubular members 200 and 202 underneath the surfaces 196 and 198 of the first clasp member 180. In this position, the first and second clasp members 180 and 74 are firmly joined together.

Figure 14:
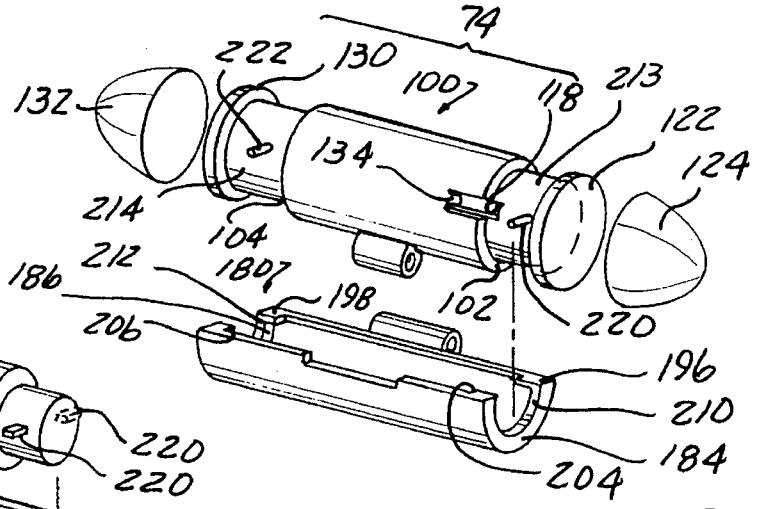
FIG. 14 is an exploded, perspective view of yet another embodiment of the first and second clasp members according to the present invention.

FIG. 14 depicts another embodiment of the present invention in which the first clasp member 180 is formed substantially the same as that shown in FIG. 13 except that the slots formed in the first and second end walls 184 and 186 have a smoothly curved, generally circular shape, as shown by reference numbers 210 and 212, respectively.

The second clasp member 74 is also substantially the same as the second clasp member shown in FIG. 13 except that the stems 213 and 214 comprise cylindrical, tubular members extending outward from opposite first and second ends 102 and 104 of the outer tubular member 100. The stem 213 is actually a continuous portion of the first inner tubular member and is movably mounted within the outer tubular member 100 and normally biased outward from the first end 102 thereof by an internally-mounted biasing spring 135, not shown in FIG. 14. The stem or first inner tubular member 213 is guided within the outer tubular member 100 by means of the interconnected slot 118 and tab 134 in the same manner as described above.

The lock function in the embodiment shown in FIG. 14 is provided by means of a pair of outwardly-extending pins 220 and 222, only one of each pair being shown in FIG. 14. Each pair of pins 220 and 222 extends outwardly from each of the stems 213 and 214 in opposite directions and are mounted on each stem 213 and 214 at a position spaced from the respective end caps 122 and 130. When the first stem or inner tubular member 213 is compressed within the outer tubular member 100, the pairs of pins 220 and 222 are spaced closer together than that shown in FIG. 14 to permit their passage between the inner edges 204 and 206 of the lips 196 and 198, respectively, on the first clasp member 180 when the second clasp member 74 is urged into the first clasp member 180. Release of the compressive force on the second clasp member 74 enables the stems 213 and 214 to spread apart and slide through the slots or apertures 210 and 212 in the end walls 184 and 186 of the first clasp member 180, until each pair of pins 220 and 222 are disposed beneath the inward extending surfaces 204 and 206 of the lips 196 and 198 at the upper edge of the first clasp member 180 to lockingly retain the first clasp member 180 and the second clasp member 74 together.

Figure 15:
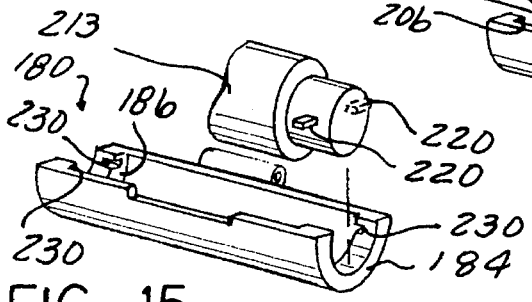
FIG. 15 is a partial exploded perspective view showing a modification to the lock means of the embodiment shown in FIG. 14.

FIG. 15 depicts a variation on the embodiment shown in FIG. 14 in which a pair of diametrically opposed notches 230 are formed in each end wall 184 and 186 of the first clasp member 180, generally adjacent to the upper edge of each end wall 184 and 186. The pairs of notches 230 slidably receive the lock pins 220 and 222 to releasably join the first clasp member 180 to the second clasp member 74.

It should be noted that due to the enlarged cross section of the stems 213 and 214 in the embodiments shown in FIGS. 13–15, the end caps 122 and 130 may be eliminated and the decorative elements 124 and 132 mounted directly on the outer ends of the stems 213 and 214.

Figure 17:
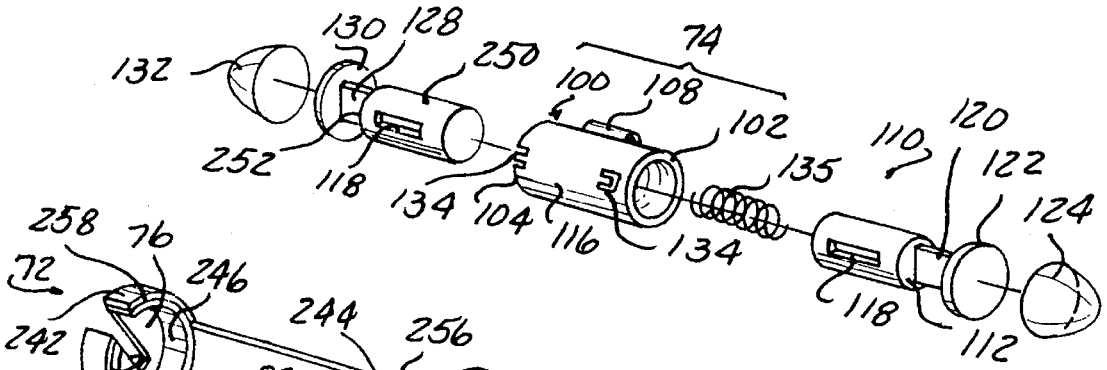
FIG. 17 is an exploded, perspective view of another embodiment of a second clasp member useable with the first clasp member shown in FIG. 16.
Figure 16:
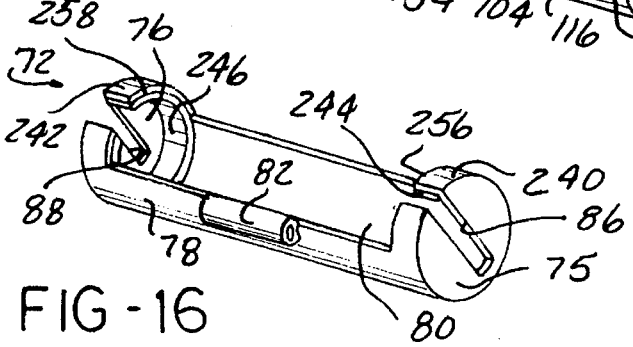
FIG. 16 is a perspective view of another embodiment of a first clasp member constructed in accordance with the teachings of the present invention.

Turning now to FIGS. 16 and 17, there is depicted yet another embodiment of the clasp of the present invention. As this embodiment represents a variation on the embodiment shown in FIGS. 4 and 5, identical elements of the first and second clasp members 72 and 74, respectively, have been identified by the same reference numbers described above and shown in FIGS. 4 and 5 for the preceding embodiment.

In this embodiment, the first clasp member 72 is formed with first and second longitudinally extending collars 240 and 242, which form an integral extension of each of the first and second end walls 75 and 76 and extend longitudinally inward from each end wall 75 and 76 toward the opposite end wall 76 or 75. Each of the collars 240 and 242 has a generally arcuate shape, substantially in the form of a circle. The slots 86 and 88 formed in the end walls 75 and 76 also extend through each of the collars 240 and 242. Annular collar inserts 244 and 246 of a generally circular shape are mounted interiorly within the first clasp member 72 below the collars 240 and 242, respectively, and immediately adjacent the end walls 75 and 76, also respectively. The slots 86 and 88 also extend through the collar inserts 244 and 246. The collar inserts 244 and 246 form a reduced diameter bore within each of the annular collars 240 and 242.

The second clasp member 74 is formed substantially identical to the clasp member 74 described above and shown in FIG. 5 except that the second stem 128 is mounted on a second cylindrical, hollow tubular member 250 which is slidably mounted within an opened second end 104 of the outer tubular member 100. The second inner tubular member 250 has generally the same shape as the first inner tubular member 110. A longitudinally extending slot 118 is formed in the side wall of the second inner tubular member 250 and is engaged by a deformable tab 134 formed at the second end 104 of the outer tubular member 100 to slidably retain the second inner tubular member 250 within the second end 104 of the outer tubular member 100 as well as to guide the sliding movement of the second inner tubular member 250 with respect to the outer tubular member 100 and to retain the second inner tubular member 250 in a set angular position with respect to the outer tubular member 100.

Compressive force applied to the decorative elements 124 and 132 causes a shortening of the overall dimension of the second clasp member 74 and brings the outermost ends 112 and 252 of the first and second inner tubular members 110 and 250, respectively, to a shorter spacing than the space between the inside edges 256 and 258 of the annular collars 240 and 242, respectively, on the first clasp member 72. This permits the first and second clasp members 72 and 74 to be joined together with the stems 120 and 128 on the second clasp member 74 slidably extending through the slots 86 and 88 in the first clasp member 72. Release of the compressive force applied to both ends of the second clasp member 74 enables the biasing spring 135 to urge both of the first and second inner tubular members 110 and 250 longitudinally outward from opposite ends 102 and 104 of the outer tubular member 100. This brings the end portions 112 and 252 of the first and second inner tubular members 110 and 250 beneath the collar inserts 244 and 246 in the first clasp member 72 to lockingly retain the second clasp member 74 in the first clasp member 72.

When it is desired to separate the first and second clasp members 72 and 74, compressive force is applied to the decorative elements 124 and 132 to shorten the overall length of the second clasp member 74 and to bring the outer ends 112 and 252 of the first and second inner tubular members 110 and 250, respectively, out of engagement with the collar inserts 244 and 246.

While the second inner tubular member 250 has been described as being movably mounted in the outer tubular member 100, it will be understood that the second inner tubular member 250 could also be fixedly mounted in the outer tubular member 100, within only the first inner tubular member 110 being movable.

At the same time, it will also be clear that the second stem 128 shown in FIGS. 5, 6 and 7 could also be mounted on a cylindrical member similar to that of the inner tubular member 110 and movably mounted for reciprocal movement through an open second end 104 of the outer tubular member 100. A tab 134 adjacent or at the second end 104 would be provided to engage a slot formed in such a cylindrical member to guide and retain the movable second stem 128 and attached cylindrical member within the outer tubular member 100.

Further, each of the alternate embodiments shown in FIGS. 8–14 could also be provided with two movable bodies carrying the respective first and second stems for sliding movement with respect to opposed ends of the outer tubular member 100.

In summary, there has been disclosed a unique clasp which not only has a strong connection between each of its components, but is also easy to operate. In addition, the present clasp may be formed in a small size, particularly with a small overall length, thereby permitting its use with small pieces of jewelry and other implements. Further, the clasp provides a secure connection between the two clasp member portions thereof which could eliminate the need for a safety chain when the clasp is used on a piece of jewelry, such as a bracelet, necklace, etc.

What is claimed is:

1. A clasp for releasably interconnecting two movable members, the clasp comprising:

first and second releasably interconnectable clasp members;

the first clasp member being in the form of a hollow, cylindrical body having first and second opposed end walls, and a side wall extending therebetween, an opening formed in the side wall of the first clasp member extending over an angular portion of the side wall;

a diametrically extending slot formed in each of the first and second ends of the first clasp member;

the second clasp member including a hollow, outer tubular member having a side wall and first and second opposed ends;

a first inner tubular member slidably mounted in the first end of the outer tubular member and having first and second opposed ends;

a first stem mounted on and extending longitudinally from the first end of the first inner tubular member;

an end cap fixedly mounted on an outer end of the first stem;

guide means, mounted on the first inner tubular member and the outer tubular member, for guiding the sliding movement of the first inner tubular member within the outer tubular member;

a second stem mounted on and extending longitudinally outward from the second end of the outer tubular member;

a second end cap mounted on an outer end of the second stem; and biasing means, mounted within the first inner tubular member and the outer tubular member, for biasing the first inner tubular member normally outward from the first end of the outer tubular member to establish a predetermined distance between the first end of the first inner tubular member and the second end of the outer tubular member, the predetermined distance being approximate to an inside spacing between the first and second end walls of the first clasp member; and lock means, formed on the first and second end walls of the first clasp member and on the first inner tubular member and the second end of the outer tubular member for releasably locking the first and second clasp members together, the lock means including:

at least one lock member mounted on at least one of the first end and the second end of the first inner tubular member; and a notch formed in a corresponding one of the first and second end walls of the first clasp member and having a shape complementary to the shape of the at least one lock member for lockingly receiving the lock member when the first and second clasp members are joined together and the first inner tubular member is biased outwardly from the outer tubular member, with the first and second stems slidably extending through the slots in the first and second end walls of the first clasp member.

2. The clasp of claim 1 wherein the lock members are arcuate-shaped bars mounted on the first end of the first inner tubular member and the second end of the outer tubular member.

3. The clasp of claim 1 wherein the lock member comprises at least one polygonal-shaped bar mounted on the first end of the first inner tubular member and the second end of the outer tubular member.

4. The clasp of claim 1 wherein the lock means comprises:

a wedge-shaped member mounted on the first end of the first inner tubular member and the second end of the outer tubular member; and a complementarily-shaped notch formed in each of the first and second end walls of the first clasp member for lockingly receiving the wedge-shaped member on the first inner tubular member and the outer tubular member when the first and second clasp members are joined together.

5. The clasp of claim 1 wherein the lock means comprises:

a tubular pin mounted on and extending longitudinally outward from the first end of the first inner tubular member and the second end of the outer tubular member; and a bore formed in the first and second end walls of the first clasp member for slidably receiving the tubular pin when the first and second clasp members are joined together.

6. The clasp of claim 1 wherein the lock means comprises:

a cylindrical boss mounted on the first end of the first inner tubular member and the second end of the outer tubular member adjacent the first and second stems, respectively; and the notches having a cylindrical shape for receiving one of the cylindrical bosses therein when the first and second clasp members are joined together.

7. The clasp of claim 1 wherein the lock means comprises:

a cylindrical boss mounted on each of the first end of the first inner tubular member and the second end of the outer tubular member;

the first stem and the second stem each including a cylindrical member extending axially from each of the cylindrical bosses; and each notch having a cylindrical shape for receiving one of the cylindrical bosses when the first and second clasp members are joined together.

8. A clasp for releasably interconnecting two movable members, the clasp comprising:

first and second releasably interconnectable clasp members;

the first clasp member being in the form of a hollow, cylindrical body having first and second opposed end walls, and a side wall extending therebetween, an opening formed in the side wall of the first clasp member extending over an angular portion of the side wall;

a diametrically extending slot formed in each of the first and second ends of the first clasp member;

the second clasp member including a hollow, outer tubular member having a side wall and first and second opposed ends;

a first inner tubular member slidably mounted in the first end of the outer tubular member and having first and second opposed ends;

a first stem mounted on and extending longitudinally from the first end of the first inner tubular member;

an end cap fixedly mounted on an outer end of the first stem;

guide means, mounted on the first inner tubular member and the outer tubular member, for guiding the sliding movement of the first inner tubular member within the outer tubular member;

a second stem mounted on and extending longitudinally outward from the second end of the outer tubular member;

a second end cap mounted on an outer end of the second stem; and biasing means, mounted within the first inner tubular member and the outer tubular member, for biasing the first inner tubular member normally outward from the first end of the outer tubular member to establish a predetermined distance between the first end of the first inner tubular member and the second end of the outer tubular member, the predetermined distance being approximate to an inside spacing between the first and second end walls of the first clasp member; and lock means, formed on the first and second end walls of the first clasp member and on the first inner tubular member and the second end of the outer tubular member for releasably locking the first and second clasp members together, the lock means including:

an inwardly extending lip formed on each of the first and second end walls of the first clasp member, the lip being disposed on each side of the slot on each of the first and second end walls; and a pair of lock members mounted on and extending laterally outward from opposite sides of the first and second stems and engaging the lips when the first and second clasp members are joined together and the first inner tubular member is urged outward from the outer tubular member such that the first and second stems slidably extend through the first and second slots in the first and second end walls of the first clasp member.

9. A clasp for releasably interconnecting two movable members, the clasp comprising:

first and second releasably interconnectable clasp members;

the first clasp member being in the form of a hollow, cylindrical body having first and second opposed end walls, and a side wall extending therebetween, an opening formed in the side wall of the first clasp member extending over an angular portion of the side wall;

a diametrically extending slot formed in each of the first and second ends of the first clasp member;

the second clasp member including a hollow, outer tubular member having a side wall and first and second opposed ends;

a first inner tubular member slidably mounted in the first end of the outer tubular member and having first and second opposed ends;

a first stem mounted on and extending longitudinally from the first end of the first inner tubular member;

an end cap fixedly mounted on an outer end of the first stem;

guide means, mounted on the first inner tubular member and the outer tubular member, for guiding the sliding movement of the first inner tubular member within the outer tubular member;

a second stem mounted on and extending longitudinally outward from the second end of the outer tubular member;

a second end cap mounted on an outer end of the second stem; and biasing means, mounted within the first inner tubular member and the outer tubular member, for biasing the first inner tubular member normally outward from the first end of the outer tubular member to establish a predetermined distance between the first end of the first inner tubular member and the second end of the outer tubular member, the predetermined distance being approximate to an inside spacing between the first and second end walls of the first clasp member; and lock means, formed on the first and second end walls of the first clasp member and on the first inner tubular member and the second end of the outer tubular member for releasably locking the first and second clasp members together, the lock means including:

the first clasp member having a generally semi-circular shape with the first and second end walls each terminating in an upper edge substantially co-planar with an upper edge of the side wall thereof;

a pair of notches formed in the first and second end walls adjacent the upper edges thereof; and a pair of lock members mounted on and extending laterally outward from opposite sides of the first and second stems for slidably engaging the pairs of notches in the first and second end walls of the first clasp member when the first and second clasp members are joined together.

10. The clasp of claim 1 further comprising:

a second inner tubular member in the form of a substantially cylindrical member mounted in an open second end of the outer tubular member;

the second stem being fixedly mounted on and extending longitudinally outward from one end of the cylindrical member; and the biasing means being seated between the first and second inner tubular members for normally biasing the first and second inner tubular members longitudinally outward from opposite first and second ends, respectively, of the outer tubular member.

11. A clasp for releasably interconnecting two movable members, the clasp comprising:

first and second releasably interconnectable clasp members;

the first clasp member being in the form of a hollow, cylindrical body having first and second opposed end walls, and a side wall extending therebetween, an arcuate opening formed in the side wall of the first clasp member extending over an angular portion of the side wall, the aperture terminating at opposed ends spaced from the first and second ends of the outer tubular member to form first and second arcuate collars at the first and second ends of the outer tubular member;

a diametrically extending slot formed in each of the first and second ends of the first clasp member and extending through the first and second collars;

the second clasp member including a hollow, outer tubular member having a side wall and first and second opposed ends;

a first inner tubular member slidably mounted in the first end of the outer tubular member and having first and second opposed ends;

a planar stem mounted on and extending longitudinally from a first end of the first inner tubular member;

an end cap fixedly mounted on an outer end of the stem;

guide means, mounted on the first inner tubular member and the outer tubular member, for guiding the sliding movement of the first inner tubular member within the outer tubular member;

a second inner tubular member mounted on the second end of the outer tubular member;

a second stem mounted on and extending longitudinally outward from the second inner tubular member;

a second end cap mounted on an outer end of the second stem; and biasing means, mounted within at least the first inner tubular member and the outer tubular member and seated between the first and second inner tubular members for biasing the first inner tubular member normally outward from the first end of the outer tubular member to establish a predetermined distance between outer ends of the first and second inner tubular members, the predetermined distance being approximate to an inside distance between the first and second end walls of the first clasp member such that portions of the first and second inner tubular members are retainably disposed within the first and second collars, respectively, on the first clasp member to interconnect the first and second clasp members together.

* * * * *

UNITED STATES PATENT AND TRADEMARK OFFICE

CERTIFICATE OF CORRECTION

PATENT NO. : 5,457,860
DATED : October 17, 1995
INVENTOR(S) : Richard A. Miranda It is certified that error appears in the above-indentified patent and that said Letters Patent is hereby corrected as shown below:

Column 9, line 31, delete "168" and insert --169--.

Column 9, line 33, delete "168" and insert --169--.

Column 9, line 36, delete "168" and insert --169--.

Column 9, line 41, delete "168" and insert --169--.

Signed and Sealed this

Twenty-eighth Day of May, 1996

*Attest:*

Bruce Lehman

BRUCE LEHMAN

*Attesting Officer*

*Commissioner of Patents and Trademarks*